United States Patent [19]

Casco et al.

[11] 3,968,954

[45] July 13, 1976

[54] OCEANOGRAPHIC APPARATUS

[75] Inventors: Ernest L. Casco; Ralph F. Kosic, both of San Diego, Calif.

[73] Assignee: General Dynamics Corporation, St. Louis, Mo.

[22] Filed: May 17, 1974

[21] Appl. No.: 471,085

[52] U.S. Cl. ..... 254/186 R; 242/84.2 B

[51] Int. Cl.[2] ..... B66D 1/00

[58] Field of Search ..... 254/186 R, 150 R, 173 R; 242/84.2 B, 84.41, 158 R, 128 R, 82; 73/300, 170 R; 340/5 R; 114/210 R

[56] References Cited

UNITED STATES PATENTS

| | | | |
|---|---|---|---|
| 449,207 | 3/1891 | Cunningham et al. | 254/150 R |
| 2,554,804 | 5/1951 | Amundson | 254/190 R |
| 2,793,740 | 5/1957 | Daudt | 254/149 |
| 2,998,094 | 8/1961 | Fisher | 254/186 R |
| 3,045,975 | 7/1962 | Bolton | 254/190 R |
| 3,083,675 | 4/1963 | Rice | 114/210 |
| 3,215,405 | 11/1965 | Walsh | 254/190 R |
| 3,524,606 | 8/1970 | Coski | 254/186 R |
| 3,690,409 | 9/1972 | Brauss | 254/186 R |
| 3,715,084 | 2/1973 | Weiss, Jr. | 254/150 R |
| 3,747,896 | 7/1973 | Botzum | 254/150 R |
| 3,784,166 | 1/1974 | Renfroe | 254/186 R |
| 3,804,371 | 4/1974 | Mills et al. | 254/186 R |

*Primary Examiner*—Frank E. Werner
*Assistant Examiner*—Kenneth Noland
*Attorney, Agent, or Firm*—Martin Lukacher

[57] ABSTRACT

Oceanographic instrumentation apparatus for securing data respecting ocean characteristics (temperature, pressure and etc.) in a manner such that a continuous profile of such characteristics with respect to depth can be obtained is herein described. A cable, at the end of which is attached a sensor, is wound around a reel having a flange in which a spiral cam is formed. In order to deploy the sensor, the reel is adapted to tilt to a downward vertical position so as to permit free fall of the sensor and cable over the cam flange and through a fairlead which may be secured in and so as to extend through the hull of a ocean data buoy. The reel is tilted to a horizontal position and rotated in order to retrieve the sensor, the cam flange guiding the cable onto the hub of the reel which may be rocked during winding so as to obtain a level wind on the reel hub. The fairlead protects the sensor once it is retrieved and prevents damage to the cable due to impact while the cable is being rewound. During free fall, the weight distribution and hydrodynamic shape of the sensor provides for stability and a substantially constant drop rate while data respecting the ocean characteristics is transmitted to the surface via a conductor in the cable and using sea water as a return path.

18 Claims, 12 Drawing Figures

OCEANOGRAPHIC APPARATUS

The present invention relates to oceanographic apparatus and particularly to a reeling system which is adapted to deploy and retrieve a sensor body which is attached to a line or cable so that measurements of ocean characteristics may be made through the use of the sensor. The invention described herein was made in the course of or under a contract with the United States Government, Department of the Navy.

The invention is especially suitable for use in oceanography for obtaining data from which a profile of ocean characteristics with respect to depth can be obtained. The invention is also suitable for use in other oceanographic apparatus in which cables or lines are deployed and retrieved, as well in other applications where our lines are payed out and rewound or otherwise reeled.

A winding mechanism suitable for use in an ocean profiler system is described in our U.S. Pat. No. 3,782,692 issued Jan. 1, 1974. Reference may also be had to the following Patents for further background information respecting winding and reeling mechanisms used in oceanographic applications: Pat. Nos. 1,359,763; 3,273,111; 3,298,222; 3,339,407; 3,389,875; 3,469,444; 3,536,298; and 3,511,092. The need has existed for sometime for apparatus whereby a line or cable, hereinafter referred to generally as a cable, may be unwound and then rewound such that a sensor or some other body can be deployed and retrieved from the ocean. Although long sought after, apparatus which is reliable even when a subject to prolonged exposure in adverse environmental conditions, as often encountered at sea in unmanned ocean bouys has not been fully realized. Satisfactory apparatus for deployment and retrieval of cables in oceanographic systems has not been obtained even though the art of winding and reeling or winching has become highly developed, as may be observed by reference to the following U.S. Pat. Nos. 2,549,029; 2,836,921; 3,155,340; 3,202,372; 3,226,052; and 3,771,487.

Accordingly it is a principal object of the present invention to provide improved oceanographic apparatus.

It is a further object of the present invention to provide improved apparatus for sensing oceanographic parameters (such as temperature, pressure and conductivity) at great depths, repeatedly and automatically, so as to obtain a profile of such characteristics with respect to depth.

It is still further object of the present invention to provide improved apparatus for making oceanographic measurements by deploying and retrieving sensor devices, which apparatus is capable of automatic, unattended operation as on unmanned ocean buoys.

It is still further object of the present invention to provide an improved system for automatic acquisition of data as to the profile of temperature and other characteristics of the ocean with respect to depth.

It is still further object of the present invention to provide improved oceanographic instrumentation apparatus wherein a cable is payed out and retrieved, which apparatus is capable of reliable operation under extreme operating conditions, as at sea for prolonged periods, say several months in locations where maintenance and repair is difficult or impossible.

It is a still further object of the present invention to provide improved oceanographic instrumentation which is capable of being serviced as by replacement of a sensor or probe even when deployed at sea in normally unmanned ocean data buoys.

It is a still further object of the present invention to provide improved oceanographic instrumentation systems for automatically dropping and retrieving a sensor body which is attached into the end of a very long cable and which allows the sensor body to be dropped to great depths in the ocean.

It is a still further object of the present invention to provide an improved sensor body for use an oceanographic instrumentation system, which body is adapted to fall to great depths into the ocean and at a uniform rate to facilitate measurement of the profile of ocean parameters as a function of depth.

It is a still further object of the present invention to provide an improved system for dropping a body attached to a cable into the ocean and retrieving that body in which the cable is protected against stress and strain especially upon retrieval.

It is a still further object of the present invention to provide an improved oceanographic system wherein a sensor body attached to a cable is dropped and retrieved and in which interference with free fall of the body or the cable is substantially eliminated.

It is a still further object of the present invention to provide an improved oceanographic system wherein a sensor body attached to a cable is dropped and retrieved and wherein interference with the cable which can cause wear and tear or damage thereto upon retrieval is substantially eliminated.

Briefly described, oceanographic apparatus involving the invention is adapted to deploy a body which is attached to a cable and so that it can fall into the ocean and then be retrieved therefrom. The cable is adapted to be wound on a reel when the body is retrieved. The reel has an opening therethrough which extends between the opposite ends thereof. The cable extends through the opening. The reel is tilted downwardly to deploy the body and the cable. The cable is allowed to become detached from the reel and pass over a flange at the end thereof, as the body descends into the ocean. To retrieve the body, the reel is tilted upwardly such that the cable extends vertically over the flanged end of the reel. The flanged end is formed with a cam surface so as to guide the cable on to the hub of the reel. When the reel is rotated while it is in its upward position, the cable is then wound on to the hub of the reel and the body is retrieved. The body may contain sensors which translate ocean parameters into electrical signals which are carried by an electrical conduit in the cable to the surface while the cable is deployed or while it is retrieved, the former being preferable. Accordingly a profile of the ocean characteristics represented by the electrical signals can be readily obtained.

The foregoing objects and advantages of the present invention as well as additional objects, advantages and features thereof will become more readily apparent from the reading of the following description in connection with the accompanying drawings in which.

Figure 3:
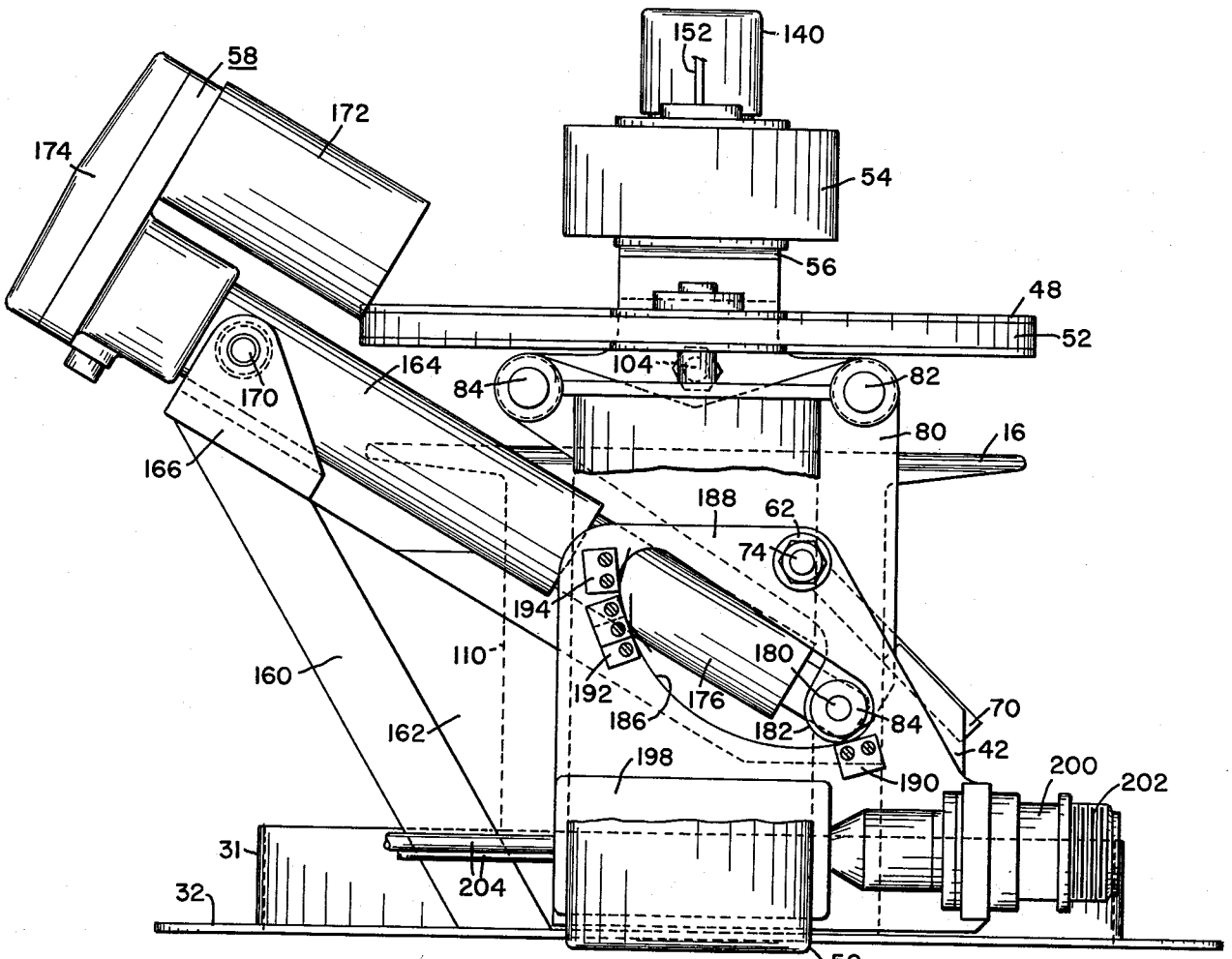
FIG. 3 is an end view, taken from the left in FIG. 1 and showing the portion of the apparatus which is located generally above the hull as viewed in FIG. 1, this portion containing mechanism for deploying and retrieving the sensor body of the apparatus.
Figure 6:
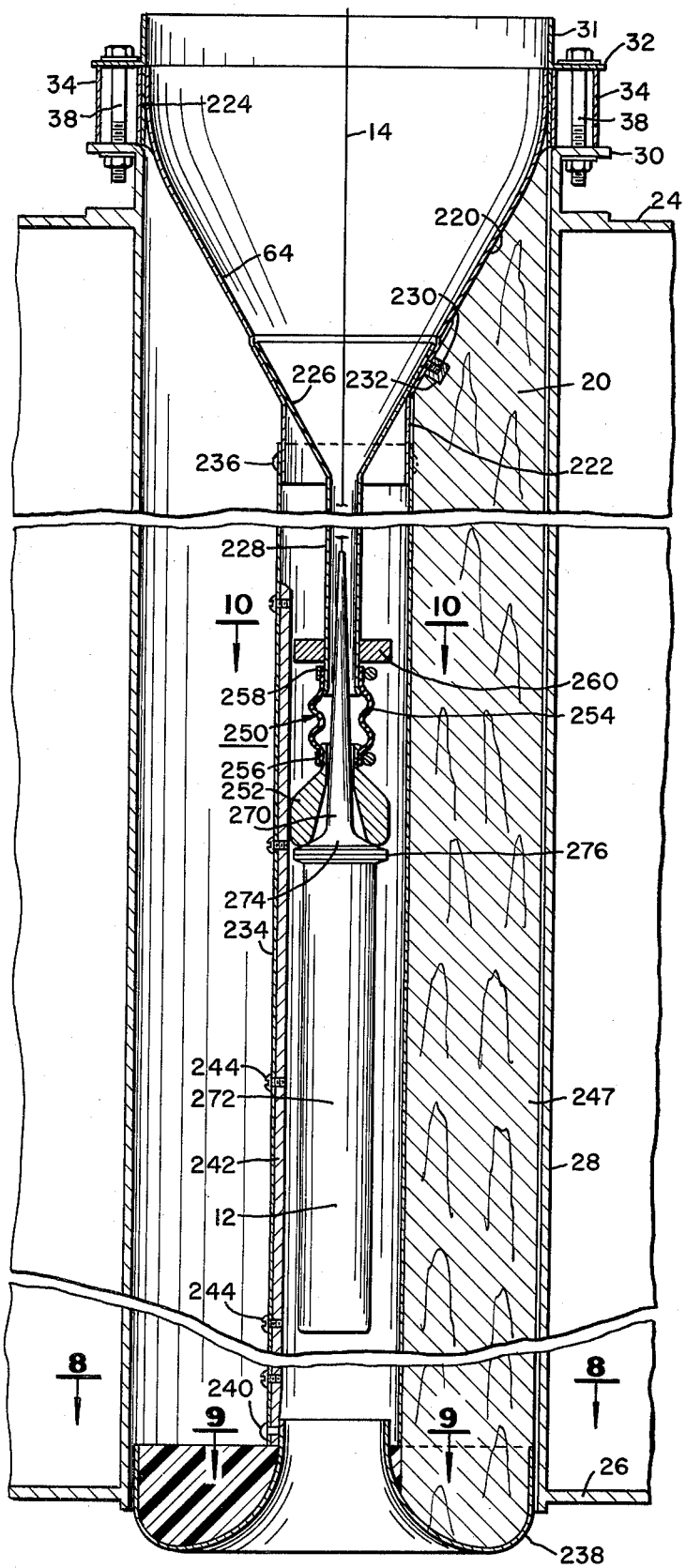
FIG. 6 is a sectional view similar to FIG. 5 but showing the portion of the apparatus which is mounted below the portion shown in FIG. 5 (generally within the hull of the buoy)
Figure 8:
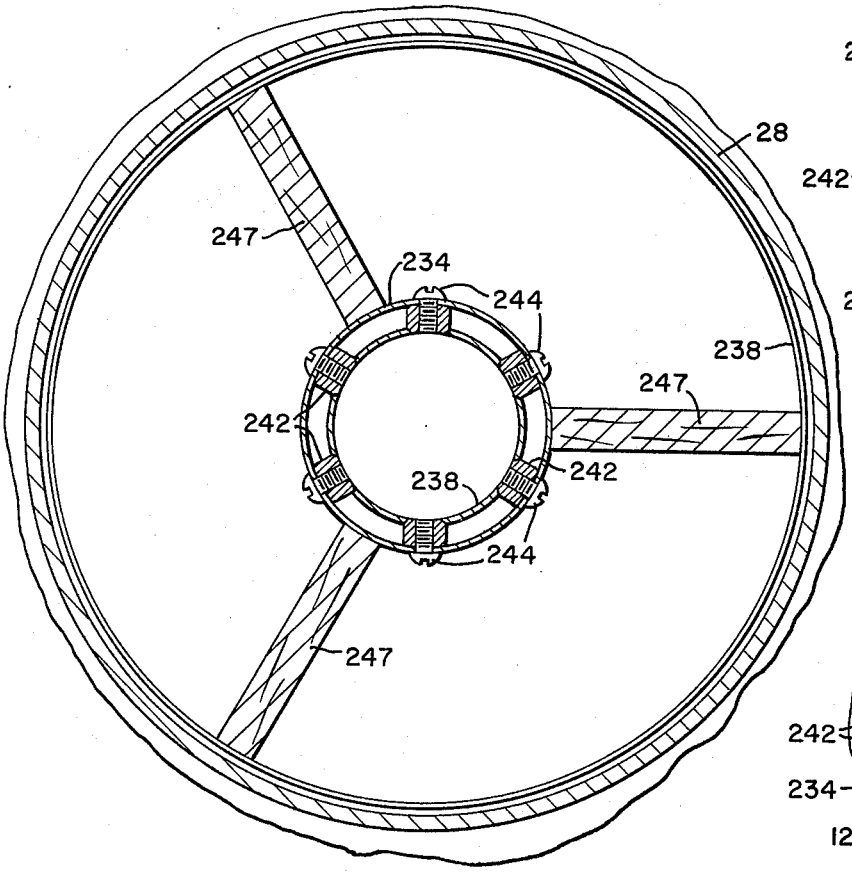
Figure 9:
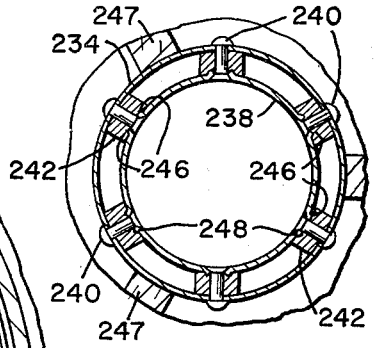
Figure 10:
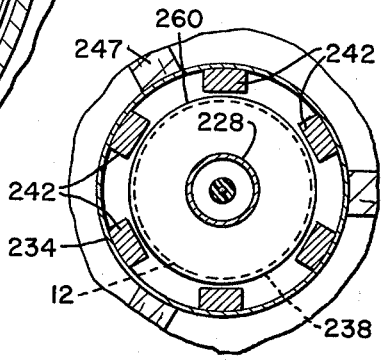
Figure 12:
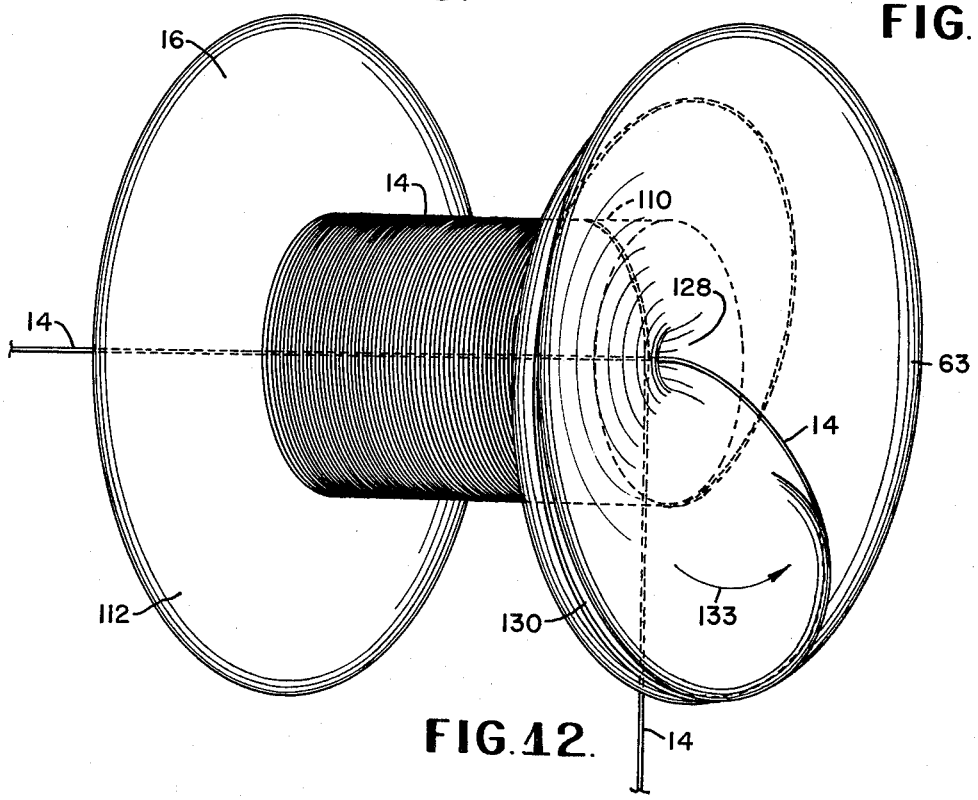
Figure 11:
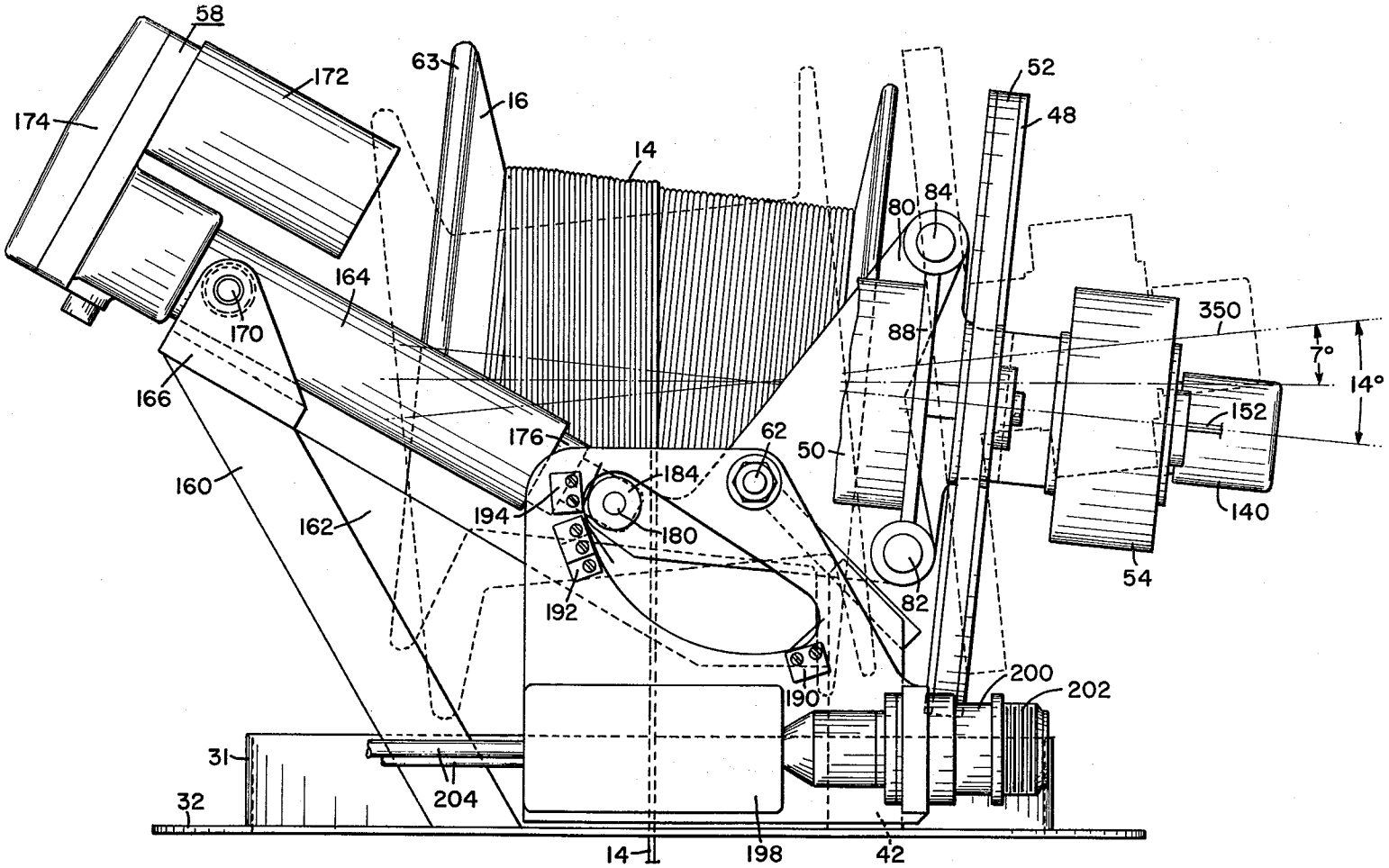

FIGS. 8, 9 and 10 are fragmentary sectional plan views taken along the lines 8—8, 9—9 and 10—10 in FIG. 6, respectively;

FIG. 11 is a simplified plan view similar to the view shown in FIG. 3 but with the apparatus in the retrieved position, while FIG. 3 illustrates the apparatus in the position for deployment of the sensor body and cable; and FIG. 12 is a perspective view, illustrating the reel used in the apparatus illustrated in the previous figures.

Figure 1:
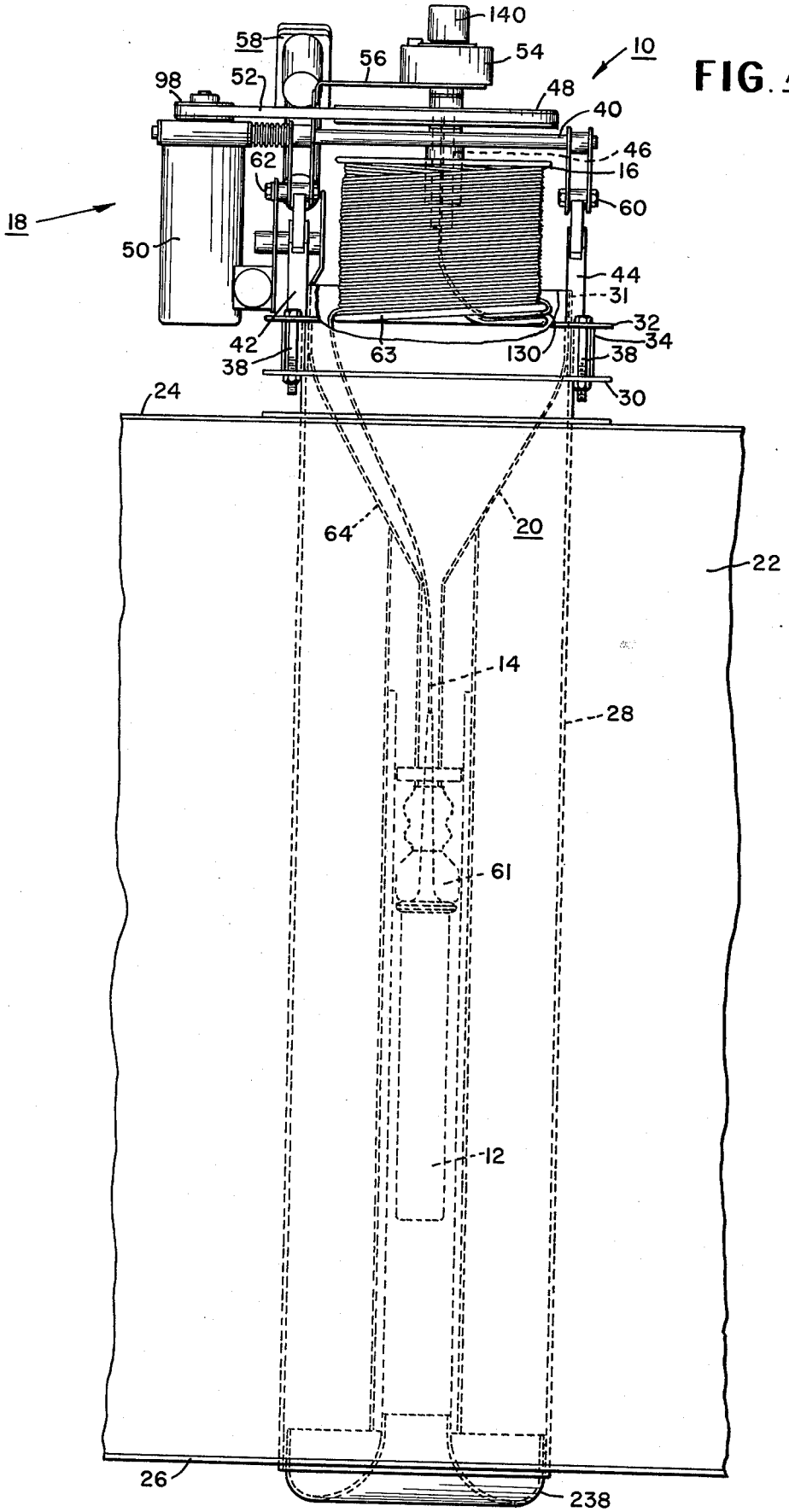
FIG. 1 is a side view of oceanographic apparatus embodying the invention, shown mounted in the hull of an ocean buoy.
Figure 2:
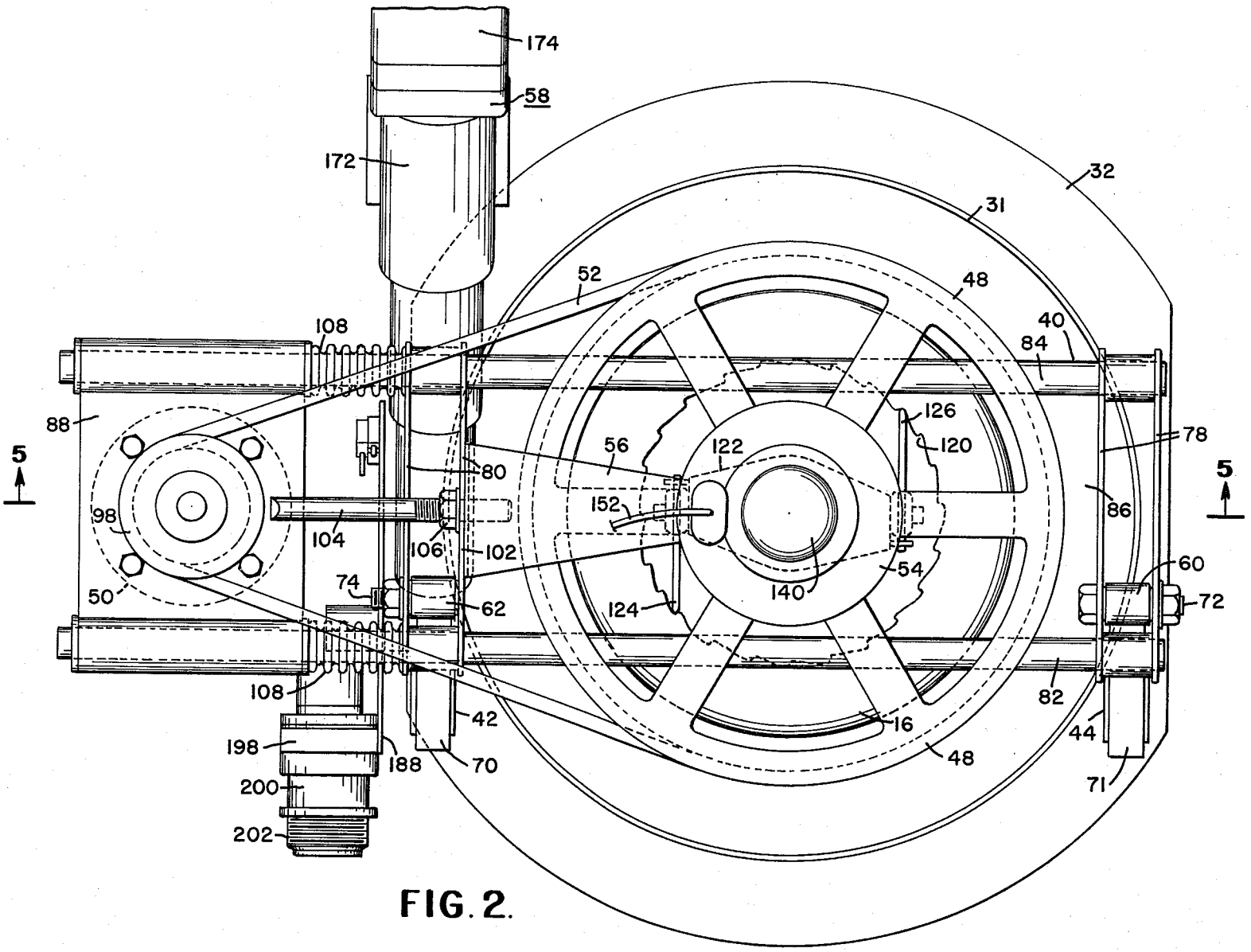
FIG. 2 is a top view of the apparatus shown in FIG. 1.

Refering more particularly to FIG. 1. There is shown oceanographic apparatus 10 for deploying and retrieving a sensor body 12 which is attached to the end of a cable 14. The sensor and the cable are shown in the position in which they are disposed just before being deployed into the ocean. The cable is wound on a reel 16; enough cable being on the reel to permit the sensor to drop say 1,000 feet and in so doing provide data from which a profile of ocean characteristics or parameters (temperature, pressure, conductivity, etc.) with respect to depth may be obtained.

The reel 16 is part of the reeling or upper portion 18 of the apparatus. A fairlead portion 20 which is disposed below the reeling portion provides for the guidance and protection of the conductor cable 14 as well as the sensor 12. Both the reeling portion 18 and the fairlead 20 are mounted in the hull 22 of a ocean data buoy. The buoy may carry radio communications equipment for transmitting the data collected by the sensor to remote stations either on ship or on shore. The buoy may be moored in deep water as by a long mooring cable. Inasmuch as the buoy can be deployed for a prolonged period of time, say several months, throughout which it is unmanned except for occasionaly inspections of the instrumentation apparatus, requisite features of reliability and resistance to adverse environmental conditions are provided by the invention.

The hull 22 of the buoy has upper and lower deck plates 24 and 26 through which a tube 28 extends to provide a water-tight compartment within the hull 22. The tube extends above the deck plate 24 and terminates in a circular flange 30. The fairlead 20 as well as the reeling portion 18 are mounted on this flange 30. Mounting rings 32 which extend from the top of the fairlead 20 as well as from the bottom of the reeling portion 18 are located on spacers 34 through which bolts 38 extend to secure the rings 32 to the flange 30. The spacers 34 may be part of the fairlead 20 such that the reeling portion 18 may be removed from the hull as an assembly, exposing the fairlead portion 20 which may be removed together with the sensor 12 for servicing.

The reeling portion includes a frame 40 which is pivotly mounted on legs 42 and 44 connected to the mounting ring 32. The frame 40 carries a shaft 46 which is turned by a pulley 48 for purposes of rotating the reel 16 during retrieval operations. A motor 50 drives a belt 52 which rotates the pulley 48 and thus the reel 16.

The cable 14 includes an electrical conductor to which contact is made in a slip ring assembly 54 carried at the top of the shaft 46. The slip ring assembly 54 is mounted on the frame 40 by means of a bracket 56. The frame is tilted by a linear motion actuator 58 about pivots 60 and 62 provided by bearings in the legs 42 and 44 in which the frame 40 is journaled. The apparatus 10 is shown in the position at the instant the frame 40 has been tilted to its downward position and has just reached that position. The sensor 12 is up into the fairlead against a guide and bumper assembly 60. The cable 14 extends to the outer layer of turns on the reel 16 and will become detached from the reel, turn by turn as the sensor body 12 descends into the ocean. The cable 14 is secured in the slip ring assembly 54 and extends through the reel 16 and around the end flange 62 to the first or intermost turn of cable wound on the hub of the reel 16. Accordingly when the entire cable has fallen and become detached from the reel 16, it will have moved from the position shown in FIG. 1 where it is draped along the wall of the upper or conical section 64 of the fairlead 20 to a vertical position which is a continuation of the axis of the reel 16.

To retrieve the sensor body 12, the actuator 58 pulls and tilts the frame 40 about the axis of the pivots 60 and 62, in a clockwise direction as view from the right in FIG. 1 so that the reel 16 axis is approximately in a horizontal position. The motor 15 then begins to turn the reel 16. The cable 14 is then guided by a cam surface in the end flange 63 to fall onto the hub of the reel such that the cable is tangential to the reel hub. As winding continues, the linear actuator 58 is operated to rock the reel back and forth so as to facilitate a level wind of the cable on the reel hub.

Referring to FIGS. 2 through 5, it will be observed that the legs of 42 and 44 have welded to them bars 70 and 71 which project upwardly at a 45 degree angle with respect to the plane of the mounting ring 32. The pivots 60 and 62 are provided by bushings through pins 72 and 74 extend. These pins carry link plates 78 on the right hand side as viewed in FIG. 2 and link plates 80 on the left hand side also as viewed in FIG. 2. The frame 40 is made of up of these link plates 78 and 80, rods 82 and 84 which extend in bridging relationship between these link plates 78 and 80 and a web 86 which bridges the rods 82 and 84. The rods extend to the left beyond the link plates 80 and carry another web 88 on which the motor 50 is mounted.

A cylindrical collar 90 is disposed in the web 86. the shaft 46 of the reel 16 is journaled for rotation and in this collar 90 in bushings 92 and 94. The pulley 48 is keyed to the shaft 46 and rests on a thrust bearing provided by a washer 96 disposed above a flange under bushing 94. The belt 52 is entrained around the pulley 48 and around a pulley 98 on the shaft 100 of the motor 50.

The intermost of the left link plates 80 extends upwardly above the belt 52. This upwardly extending portion 102 of the inner left link plate 80 is attached to the bracket 56 which holds the slip ring assembly 54. In order to tighten the belt, a bolt 104 may be welded to the web 88 which supports the motor 50. This bolt projects through the upwardly extending portion 102 of the link plate 80. The web 88 is mounted for sliding motion on the rods 82 and 84 and may be moved by turning bolt 104 and tightening the same with a nut 106 so as to provide the proper tension in the belt 52. The portions of the rod 82 and 84 between the upper extension 102 of the link plate 80 and the motor support web 88 may have protective coverings 108, such as bellows, thereon.

Figure 5:
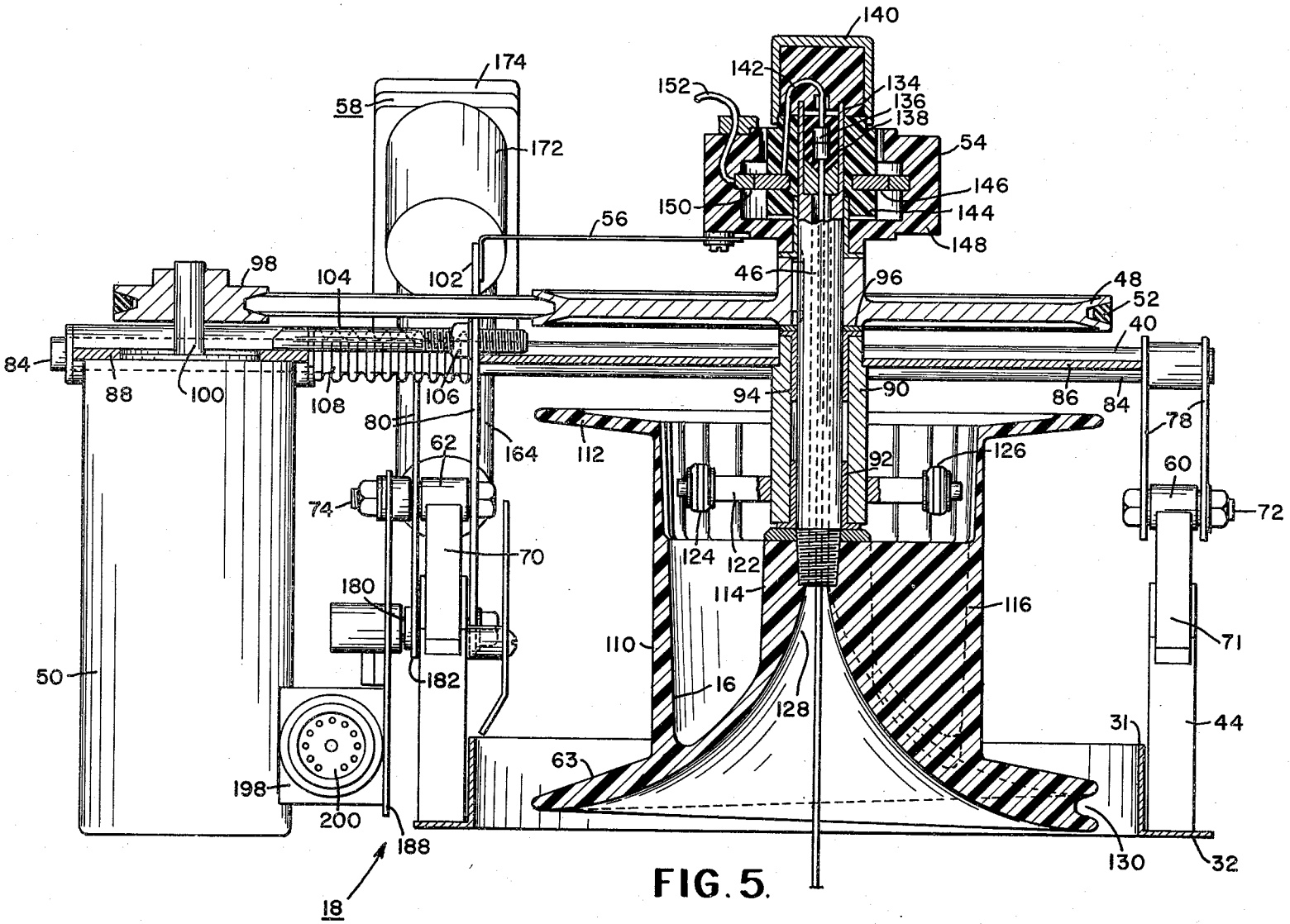
FIG. 5 is a sectional view of the portion of the apparatus shown in FIGS. 3 and 4, the section being taken along the line by 5 in FIG. 2.

The reel or spool 16 is best shown in FIGS. 5 and 12. It contains a central hub 110 which extends between the lower end flange 63 and the upper end flange 112. The reel may cast from aluminum to have a internal post 114 extending partially up from the lower flange 63 and is connected to the hub 110 by webs 116; four of which may be provided. The shaft 46 is screwed at its end into the post 114. The lower flange of the bushing 92 provides a thrust bearing surface for the upper end of the post 114 against the bottom of the collar 90. The inner periphery of the upper end of the hub 110 has a serrated surface providing a rachet 120. An elliptical plate 122 carries pawls 124 and 126 which engage the rachet 120 and allow the reel to turn in only one direction; thus preventing the cable 14 from rotating the wheel against the tension of the belt 52 when the reel is in the horizontal or retrieve position. The motor 50 is a constant torque motor; thus eliminating the need for slip clutches to provide constant torque during winding, when the cable is being reeled in.

The lower end flange 63 is formed with a spiral cam therein for guiding the cable 14 onto the hub 110 at the onsent of retrieval operations. The cam surface is located in a groove 130 around the edge of the flange 63. The cam starts approximately at the center or axis of the reel 16 (i.e., at opening 128 which extends through the reel along the axis thereof and provides a path for the cable 14 along the axis of the reel 16). Thus, as the reel is tilted to its horizontal position and begins to rotate in the direction indicated by the arrow 133 in FIG. 12, the portion of the cam along the outer face of the flange 62 will pick up the cable and guide it into the groove 130. This outer portion extends approximately 90 degrees around the end face 62, whence the groove then continues for an additional 120 degrees approximately until it reaches the hub 110 where the cam deposits the cable to begin the first turn around the hub 110. It will be apparent therefore, that no bails or striker mechanisms are required which will interfere with the cable 14 or cause it to spin or otherwise be deflected during retrieval operations. The chances of the cable then being directed into contact with the mooring line for the buoy or other obstructions which could foul it are therefore substantially eliminated.

The cable 14 rotates with the reel 16. The upper end of the cable is securely fastened in a cup 134 formed in the upper end of the shaft 46. Beads 136 are fastened to the upper end of the cable to hold it securely in resilent material which may be a body of the epoxy potting resin 148. A cap 140 through which the resin may be supplied to the cup 134 is located on top of the cup 134 for securing a lead 142 to the beads 136 which are also of conductive material. The cap 140 also serves to protect the cable against exposure. The cap and shaft are attached to a rotary cylinder 144 within the slip ring assembly 54. A slip ring 146 to which the lead 142 is connected also rotates with the block 144. A stationary ring 148 of insulating material, the rotary block 144 also being of insulating material, carries a brush assembly 150. A conductor 152 is attached to the brush assembly 150. The data signals are therefore available at the lead 152 which may be connected to the electronic equipment on board the buoy, such as radio transmitters for transmitting the data signals to remote stations.

The linear actuator 58 for tilting the frame 40 is mounted on a leg 160 which is welded to the mounting ring 32 (see FIG. 3); the leg extending upwardly from the mounting ring at an angle of about 60 degrees. A further support for the leg 160 is provided by a gusset 162 which may be welded to the leg and to a cylindrical housing 164 of the actuator 58. The cylinder 164 is also secured in a cradle 166 which is fastened to the cylinder 164 by a mounting pin 170.

Figure 4:
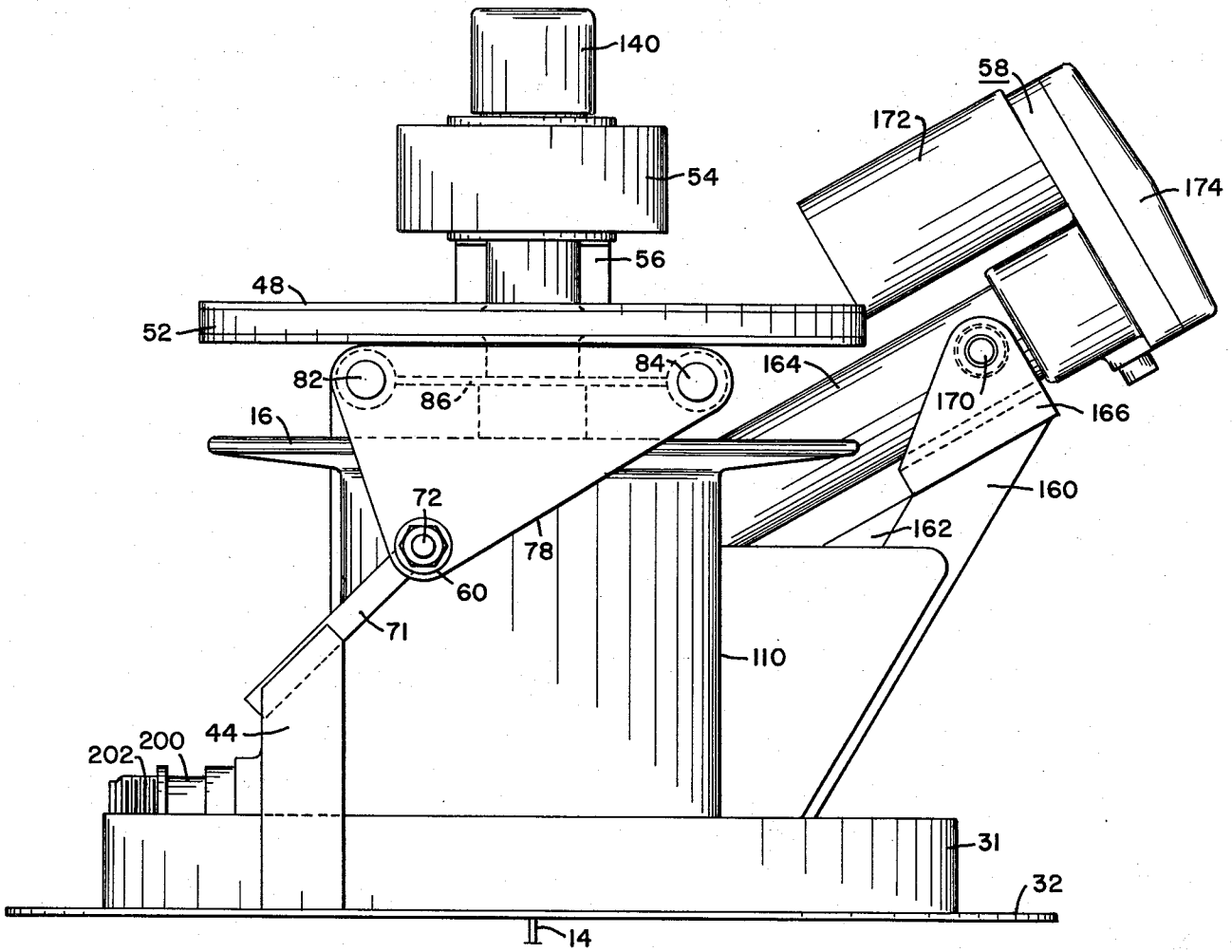
FIG. 4 is an end view, taken from the right-hand side of the apparatus as shown in FIG. 1 and showing the same portion of the apparatus as is illustrated in FIG. 3.

The actuator 58 consists of an electric motor 172 which drives gearing enclosed in a housing 174 where the gearing operates a worm gear which extends along the cylinder 164 and advances or retracts a piston 176. The piston is pivotally mounted at its end by a pin 180 in a finger 182 extending from the bottom of the outer left hand link plate 80. A roller 184 which is mounted for rotation on the pin 180 extends through a slot 186 in a switchplate 188. Three banks of switches are mounted on the plate 188 along the edge of the slot 186, namely a lower limit switch 190 and upper limit switches 192 and 194. When the piston 176 is extended, the reel is tilted to the vertical or deploy position as shown in FIGS. 3, 4 and 5 of the drawing. When the piston 176 is retracted so that it is located near the upper end of the slot 186, the reel is in the horizontal or retrieval position for winding purposes.

The switchplate 188 also carries a terminal block 198 and a connector 200. The connector contains pins which receive a complimentary connector which may be screwed thereon as at the threads 202. Electrical power for operating the motors 50 and 172 is supplied by a conduit which is attached to the connector 200. This power is distributed by way of leads 204, the full extent of which are not shown to simplify the illustration, to the motors 50 and 172. The application of power to the motors as well as the distribution of the data signals is also by way of electrical signals carried by conductor 152 and by conductors connected to the switches 190, 192 and 194. These conductors are also connected to the terminal block, again not shown to simplify the illustration. The conductors are connected by way of the connector 200 to circuitry for controlling the application of power to the motor as well as the radio communications or other telemetry circuitry discussed above. Inasmuch as relay or other switching circuitry for applying power in response to switch closures, with time delay if necessary may be implemented in accordance with conventional techniques, such circuitry is not discussed in detail herein. The linear actuator 58 therefore operates to tilt the frame about its pivots to bring the reel into position for deployment or retrieval of the sensor. The upper limit switches 192 and 194 also set the extremes of a rocking motion of the frame and of the reel 16 (approximately 14° in total) so as to assist in level winding of the cable on the hub 110 of the reel during retrieval operations.

The fairlead 20 is illustrated in detail in FIGS. 6, 8, 9 and 10. It consists of a generally conical shape cup 220 desirably of laminated resin impregnated glass fibers sold commercially under the tradename fiberglass. A cylindrical ring 224 is cemented around the outer periphery of the upper end of the cup 220. The bottom end of the cup 220 is in the form of a cylindrical collar 222. The spacers 32, which may be four in number disposed 90 degrees apart, are cemented to the ring 224. The spacers 32, the ring 224 and the upper end of the cup 220 may be laminated together to provide a unitary assembly, the spacers 32 appearing as ears on the cup 220. The mounting ring 32 is attached to the flange 30 by means of the bolts 34 so that the entire reeling portion 18 may be lifted off the flange 30 to expose the fairlead cup, which together with the remaining parts of the fairlead 20 may be lifted out of the hull tube 28 as an integral assembly.

A funnel 226 having an elongated neck 228 is attached to the cup 220 as by screws 230 which are covered by protecting caps 232. The funnel is preferably made of corrision resistant metal such as stainless steel. A sensor storing cylinder 234 is fastened to the collar 222 as by rivets 236. This cylinder 234 is desirably made of copper, which is exposed in and may be partially under the water line the cylinder 234 releases copper ions as by leaching so as to protect against the formation of marine life (e.g. barnacles) on the sensor body 12. A bell-mouth 238 is attached to the bottom of the cylinder 234 as by rivets 240. A plurality of elongated spacers 242 are disposed vertically along the inner periphery of the cylinder 234 and are attached thereto by screws 244. The spacers 242 are desirably of nylon or other non-corrosive (e.g. plastic) material and the screws 244 are also of such material. The ends of the screws desirably do not project beyond the inner edge of the spacers 242. In order that the rivets 240 as well as the screws 244 do not interfere with the sensor body 12, the holes 246 in the bell-mouth 238 which receive the rivets 240 or screws are tapered inwardly so that they may be engaged by the ends of the screws without the screws 240 projecting through the surface of the bell-mouth 238. Three wooden spars 247 extend vertically from the cup 220 where they may be fastened to the cup and funnel 226 by means of the some of the screws 230. These spars extend into the bell-mouth 238, which with the spars therein may be filled with glass fibers and resin so as to lend structural rigidity to the bell-mouth 238 as well as to the entire fairlead assembly 20. A shock absorber arrangement 250 is attached to the lower end or the neck 228 of the funnel 226 and includes a conical guide structure 252 which may also be of resilient non-corrosive material (e.g. plastic such as nylon) and a bellows 254 of the type found in radiator hose. Clamps 256 and 258 attach the bellows to the guide 252 and to the lower end of the neck 228, respectively. A locating disk 260 around the neck 228 assists in centering the neck 228 as well as the shock absorber arrangement 250. The guide disk 260 is desirably made of resilient material like the guide 252 (e.g. nylon).

The sensor 12 a hydrodynamic body, generally cylindrical in shape, having a tail 270 in which the cable 14 is securely fastened. The tail joins the cylindrical portion 272 of the sensor body at a conical seat 274 which flares outwardly to form a circular rim 276 of diameter greater than the diameter of the cylindrical portion 272 of the sensor body. As shown in FIG. 6 the seat 274 shields the orifice within the fairlead through which sea water may enter by providing a tight fit with the lower edge of the guide 252. The guide and shock absorber arrangement 250 also absorbs impact of the sensor upon retrieval. The tail 270 also serves to guide the sensor body 12 around the buoy mooring lines and into the bell-mouth 238 and prevents any cable wedging in the storage cylinder 234 or in the funnel 226.

Figure 7:
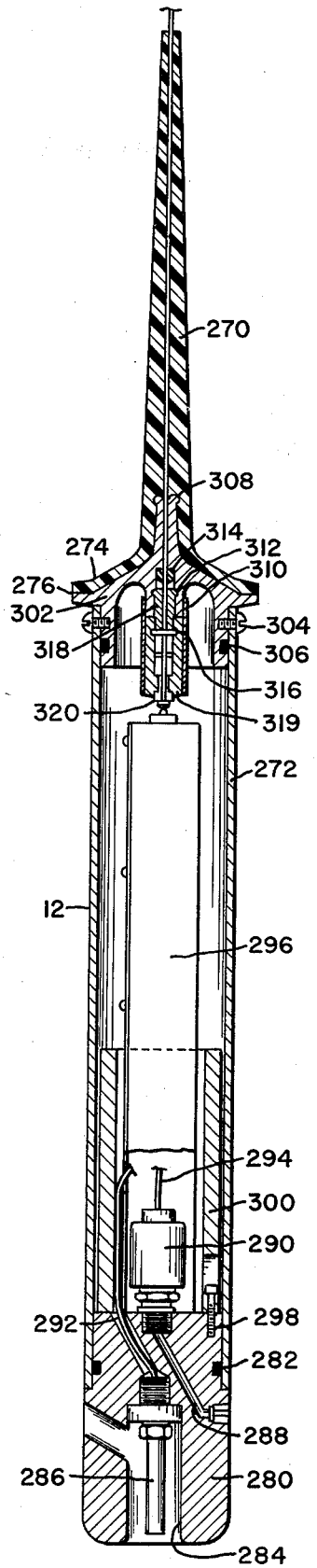
FIG. 7 is a sectional view illustrating the sensor body as shown in FIGS. 1 and 6.

The sensor 12 is shown in greater detail in FIG. 7 as including a cylindrical shell desirably made of corrosion resistent metal such as stainless steel. A base or plug 280 is threaded into the bottom of the shell 272 a further seal being provided by an o ring 282. The base contains a passage 284 through which the sea water may rush as the sensor body is deployed or retrieved. A sensor such as a temperature responsive transducer 286 is mounted in the center of the plug as to be exposed to the water as it rushes through the passage 284. Attached to the top of the plug 280 and communicating to the side of the plug via a passage 288 is another sensor 290 which may be a pressure transducer. The temperature and pressure transducers 286 and 290 are of conventional design and provide electrical signals which are conducted by way of leads 292 and 294 into a container 296 which carries electronic circuitry such as signal conditioners and pulse code modulaters and multiplexers.

Also attached to the plug 280 as by screws 298 is a cylindrical weight 300. This weight 300 furnishes such additional ballast as is needed to obtain the sinking rate desired and also places the center of gravity of the sensor body in the lower portion thereof and along the axis of the body.

The tail 270 is connected to a ferrule 302 which is screwed into the upper end of the shell 272 as by screws 304. A seal is assured by means of an o ring 306. The upper end of the ferrule 302 is formed with a lip 308 which assists in providing a seal around the cable 14 as well as permits a snap fit of the tail 270 on the ferrule 302. Both the tail 270 and the ferrule 302 are desirably made of resilient material such as nylon. An internal cylindrical post 310 in the ferrule 302 has a blind hole 312 which is threaded. A grommet seal 314 at the upper extremity of the hole 312 assures that sea water will not enter the shell 272 of the sensor body 12. A disk 316 is attached to the lower end of the conductor 14. The conductor 14 extends through a plug 318 threaded in the hole 312, in order to provide a secure anchor for the end of the cable 14, a shield 319 may be disposed around the post 310 and extends downwardly into the shell 272. A lead 320 makes contact to the conductor in the cable 14 and extends into the electronic container 296. The shield 319 may be a cylinder filled with potting compound so as to provide the firm anchor for the cable 14 which is desired.

The cable may carry by its conductor the D.C. power for operating the electronic circuitry in the container 296. The return path is by way of the sea water. The electronic signals which may be A.C. signals of much higher frequency, either pulses or fm modulated telemetry data signals, are communicated up the conductor to the electronics equipment at the surface in the buoy. Again the return path is by way of the sea water.

The tail section 270 and particularly the rim 276 provide drag to afford dynamic stability during free fall of the sensor body upon development. It also assists in preventing spinning of the sensor body and the cable as it is deployed.

The operation of the reeling portion 18 will be more apparent from FIG. 11. Consider that the reel 16 is initially in the horizontal position and the cable 14 is wound thereon. A deploy command is issued to the motor 172 and the actuator mechanism 58 is operated to extend the piston 176 so as to assume the position shown in FIG. 3. When the roller 184 reaches the lower limit switch 190, the motor 172 is stopped. The lower limit switch 190 contains switch elements not only for stopping the motor but also for controlling timing circuitry. When the timing control switch in the lower limit switch 190 is actuated, a time cycle is commenced. The timing cycle is of duration sufficient to allow all of the cable 14 to become detached from the reel 16 such that the sensor body will sink to the maximum depth possible as determined by the length of the cable, say 1,000 feet. The timing cycle includes a time interval extending after the time required for the cable to become detached so as to allow for any transient motion (e.g. spinning) after the cable 14 is fully extended. Then the control system allows operating power to be applied to the motor 172 but with polarity reversed so that the motor will turn in the direction to retract the piston 176. The piston then tilts the frame 40 until the reel 16 and the roller 184 assume the position as shown by the dash lines in FIG. 11. The lower one of the upper limits switches 192 then stops the motor 172 and actuates the motor 50 for turning the reel 16. Separate switch sections (viz. separate micro switch units) each having its own switch actuating element may be provided in the switch banks for controlling power to the actuator motor 172 as well as to the reeling motor 50. In the position shown in the dash lines, the axis of the reel 16 is tilted upwardly along the line 350 which is at approximately 7° to the horizontal. The cam face 62 of the reel 16 then guides the cable 14 onto the hub of the reel to begin the first turn. The actuator motor 172 is then again started and retracts the piston 176 such that the roller 184 actuates the upper limit switch 194. When the upper limits switch 198 is actuated the motor 172 is reversed and the piston 176 is then extended downwardly until the lower upper limit switch 192 is again contacted. A switching element in the bank of lower limit switches 192 then causes the motor 172 to reverse again. The two upper limit switches 192 and 194 thus cause successive reversals of the motor and allow the reel 16 to be tilted or rocked back and forth over an arc of about 14° (viz. 7° each side of the horizontal) so as to assist in a level wind of the cable on the reel 16. After a predetermined time interval which commences when the reel 16 has first been tilted to the horizontal or retrieve position, the reeling motor 50 and the actuator motor 172 are both stopped. The closure of a switch in the bank 192 provides for the initiation of this timing operation. The actuator 58 may then commence another deployment cycle either automatically or upon command. Accordingly the cable and its sensor may be deployed and retrieved continuously so as to provide continuous information as to the temperature profile of the ocean in accordance with depth as measured by the pressure sensor transducer. Other sensor transducers may be included in the sensor body 12 to provide profiles of ocean parameters such as conductivity and the like. Inasmuch as the switch operated timing mechanisms reversing power and applying power to motors can be implemented with techniques known in the art, they are not described in detail herein.

From the foregoing description it will be apparent that there has been provided improved oceanographic apparatus especially suitable for providing profile of ocean characteristics with respect to depth. The apparatus has features which prevent any interference with a sensor body or its cable during deployment or retrieval either by the reeling mechanism or otherwise in cable and sensor guidance devices. Accordingly the apparatus will be capable of prolonged operations with high reliability even in adverse environments as at sea in unmanned ocean buoys. While an exemplary embodiment of the invention has been described, it will be appreciated that variations and modifications therein within the scope of the invention will undoubtedly suggest themselves to those skilled in the art. Accordingly the foregoing description should be taken merely as illustrative and not in any limiting sense.

What is claimed is:

1. Oceanographic apparatus comprising a. a body which descends into and is then retrieved from the ocean, b. a cable to which said body is attached, c. a reel on which said cable is adapted to be wound when said body is retrieved, d. said reel having an opening therethrough which extends between the opposite ends thereof, said cable extending through said opening, e. means for tilting said reel downwardly to bring said one end down to face the ocean thus allowing said cable to become detached from said reel as said body descends into the ocean, and then upwardly to bring said one end to a position when said cable extends vertically over said one end, and f. means for rotating said reel while it is in its upward position to wind said cable thereon and retrieve said body.

2. The invention as set forth in claim 1 wherein said reel has flanges on the ends thereof, the flange on said one end having a cam edge for causing said cable to move onto the hub of said reel when said reel is rotated.

3. The invention as set forth in claim 2 wherein said cam is a spiral cam extending between said opening at said one end and said flange edge.

4. The invention as set forth in claim 3 wherein said cam has a surface disposed in a groove in said edge.

5. The invention as set forth in claim 1 wherein in tilting means includes a frame in which said reel is journaled for rotation about its axis, and means pivotally mounting said frame for about an axis spaced from said reel axis.

6. The invention as set forth in claim 5 wherein the plane of said reel axis and the plane of said frame axis are perpendicular.

7. The invention as set forth in claim 6 wherein said tilting means further comprises means for tilting said frame back and forth over a predetermined arc while said reel is rotating in its upward position for level winding of said cable upon the hub of said reel.

8. The invention as set forth in claim 6 including a support member, said mounting means pivotally mounting said frame on said support member and wherein, said tilting means includes a reversible electric motor mounted on said support member, reciprocating means coupling said motor to said frame for tilting said frame when said motor is driven, and means mounted on said support member and activated when said frame and reel are in the downward position for operation of said motor to drive said reciprocating means so as to tilt said frame to the upward position.

9. The invention as set forth in claim 7 wherein said apparatus includes a support member upon which said pivotal mounting means in disposed, an electric motor mounted on said support memer, means coupling said motor to said frame for translating the rotational motion of said motor into linear motion for tilting said frame, and means responsive to the position of said frame for reversing said motor to provide for said back and forth tilting over said arc.

10. The invention as set forth in claim 8 wherein said cable includes an electrical conductor for carrying signals generated in said body, and wherein said cable is rotatable with said reel, and including slip ring means disposed between said cable and said frame and carried by said frame for providing connections to said conductor.

11. The invention as set forth in claim 1 further comprising a tube disposed below said one end of said reel when said reel is in the downward position, said tube having its axis coaxial with said reel opening, and a conical member extending and flaring inwardly from said reel one end into said tube for guiding said cable with respect to said reel.

12. The invention as set forth in claim 11 further comprising yieldable means disposed at the lower end of said conical member for absorbing the impact of said body against said member when it is retrieved into said tube.

13. The invention as set forth in claim 12 wherein said body has a tail through which said cable extends, said tail being conical in shape and extending into said conical member when said body is retrieved.

14. The invention as set forth in claim 13, wherein the large diameter end of said tail has a generally conically shaped flange where said tail terminates at said body, said flange having a diameter greater than the diameter of said body for controlling the rate of descent of said body into the ocean.

15. The invention as set forth in claim 14 wherein said body is generally cyclindrical in shape, said body having a blunt nose at the lower end thereof.

16. In a winding mechanism a rotatable reel adapted to be pivotally mounted upon an axis transverse to the axis of said reel, said reel having opposite ends and a peripheral surface on which a line is adapted to be wound and a flange on one of the ends of said reel, said reel also having an axial hole extending therethrough from end to end, said flange having a cam surface around the edge thereof and extending to said peripheral surface for leading a line which extends through said hole out of said flange around said flange to a point extending tangentially to the peripheral surface of said reel when said reel is pivoted from a position where said line extends generally axially of said reel to a position where said line extends in a direction transverse to the axis of said reel.

17. The invention as set forth in claim 16 wherein said flange is circular and said cam surface extends from said hole along the side of said flange which faces said peripheral surface, said cam surface defining a spiral.

18. The invention as set forth in claim 17 including a frame in which said reel is rotatably mounted and means for tilting said reel between a pay out position and a take up position, in each of which positions the axis of said reel is about 90 degrees displaced from the other.

* * * * *